United States Patent [19]

Abildgaard

[11] Patent Number: 4,674,906

[45] Date of Patent: Jun. 23, 1987

[54] BOOKBINDING STRIPS AND METHOD OF BINDING BOOKS

[75] Inventor: William H. Abildgaard, Redwood City, Calif.

[73] Assignee: Velo Bind, Inc., Sunnyvale, Calif.

[21] Appl. No.: 798,872

[22] Filed: Nov. 18, 1985

Related U.S. Application Data

[63] Continuation-in-part of Ser. No. 663,214, Oct. 22, 1984.

[51] Int. Cl.[4] ..... B42F 13/00; B42F 13/10; B42B 5/14; B42D 1/00

[52] U.S. Cl. ..... 402/80 P; 402/80 R; 402/14; 412/43; 281/21 R

[58] Field of Search ..... 412/43; 402/13, 14, 402/15, 18, 60, 64, 65, 68, 80 P, 80 R; 281/21 R, 22, 25, 28

[56] References Cited

U.S. PATENT DOCUMENTS 2,911,977 11/1959 French et al. ..... 281/21 R
3,285,250 11/1966 Ivory et al. ..... 402/14
4,369,013 1/1983 Abildgaard et al. ..... 402/80 P

FOREIGN PATENT DOCUMENTS 2409310 9/1975 Fed. Rep. of Germany .... 402/80 R
1191115 10/1959 Switzerland ..... 402/80 P
1400460 7/1975 United Kingdom .

*Primary Examiner*—Paul A. Bell
*Assistant Examiner*—Paul M. Heyrana, Sr.
*Attorney, Agent, or Firm*—Julian Caplan

[57] ABSTRACT

A first plastic strip has longitudinally spaced studs each of which can be bent over at a 90° angle. A second strip has holes through which the studs fit and grooves which receive and secure the bent over studs. Paper punched to receive the studs is clamped between the two strips. The studs are then bent over into grooves in the second strip and held in bent position. The grooves have overhanging lips which detachably retain the studs in place. The paper in thus securely bound. To prevent cracking the studs, the abruptness of the 90° bend may be relieved by forming an annular depression around the base of each stud.

8 Claims, 10 Drawing Figures

BOOKBINDING STRIPS AND METHOD OF BINDING BOOKS

CROSS REFERENCE

This application is a continuation-in-part of copending application Ser. No. 06/663,214, filed Oct. 22, 1984, entitled BOOKBINDING STRIPS AND METHOD OF BINDING BOOKS.

FIELD OF THE INVENTION

This invention relates to a new and improved bookbinding strip and method of binding books. A popular bookbinding uses a pair of strips, one strip having relatively rigid thermoplastic studs projecting therefrom, the other having holes to receive the studs. Paper formed with holes complementary to the studs is clamped between the pair of strips, the excess stud lengths are cut off and the ends of the studs preferably formed with rivet heads, completing the bind. The present invention uses flexible studs and grooves are formed in the second strip to receive the bent over stud lengths. Thus the excess stud length is not cut off.

DESCRIPTION OF THE PRIOR ART

As has been stated, pairs of plastic strips such as those shown in U.S. Pat No. 4,369,013 are widely commercially available for use in binding machines. The present invention differs from such strips in two respects: First, the studs are flexible and, second, grooves are formed in the female strip to receive the studs.

Flexible metallic studs have also commonly been used primarily for non-permanent binding of papers into folders. The commercially available binders of this type, sold under the trademark ACCOPRESS, are either used without a second strip or, when used a second strip, the latter has been of a complicated type having movable slides which hold the bent over binding strips in place.

Jacinto Pat. No. 4,305,675 shows a modification of the foregoing structure. In one modification, the edges of the thin, sheet metal prongs are serrated and the edges of the channel of the female strip have complementary serrations. The sharp prong edges are dangerous and may scratch furniture. There is no snap-in feature as in the present invention; separate covers are required to hold the prongs in place. In Jacinto the prongs overlap. In this invention, each prong has its own individual groove. The tightness of bind in Jacinto is dependent on the spacing between serrations; in the present invention, the bind may be secured in infinite adjustments. The number of studs in Jacinto is limited to two; more studs may be used in the present invention and, hence, there is less likelihood that the binding will gap open at the spine edge.

Long, flexible studs have also been used for binding computer paper and the like, but such binding strips also require complicated means for holding the bent over studs in place.

British Pat. No. 1,400,460 is a modification of the foregoing. There is no strip supporting the posts. The front and back covers hinge at difference distances from the spine edge of the book. Instead of the snap-in retainer lips extending the length of the groove, only short projections—one pair for each prong are provided. The tightness and the security of the bind is thus improved in the present invention.

OBJECT OF THE INVENTION AND SUMMARY THEREOF

The present invention provides a female strip formed with grooves and latching means of the type hereinafter described in detail, to receive flexible studs of the opposite member. An extremely secure bind is accomplished without the use of complicated machinery or complicated bent stud retaining means.

More particularly, it is an object of this invention to provide a pair of strips, one having longitudinally spaced flexible plastic studs and the other having holes complementary to the spacing of the studs adjacent one or more grooves into which the bent over studs may be inserted and also provided with retaining means of a very simple nature holding the studs in bent over position.

A further object of the invention is to provide a binding means which does not require cutting or heading of the studs. The bind may be accomplished either manually or with apparatus which is relatively simple as compared with that previously used.

Mechanical simplicity of the strips is a further object of the invention. The locking means is built into the strip. No rivetting is required.

Since it is unnecessary to cut off excess scrap length, disposal of scrap is not a problem.

Another object of the invention is that the use of flexible studs permits unsnapping the bent stud ends from the retaining means, removing the female strip, adding or subtracting sheets and then rebinding the book. If a permanent bind is desired, the stud ends or strip may be permanently deformed.

Among the advantages of the invention is the final appearance of the book. The bent over stud ends resemble stitched bindings.

The strength of the bind is highly satisfactory. Failure occurs by breakage of the studs (a function of their cross-section area) rather than by reason of the ends of the studs pulling out of the retaining means.

The length of the groove is longer than the bent-over portion of the stud, leaving room to engage the end of the stud to pull it out of the groove if it is necessary to debind the book.

Another feature of the invention is the formation of a depression in the male strip around the base of the stud. Particularly when thin books are bound, this depression presents a curved rather than a right-angle bend of the stud and reduces any tendency of the stud to crack at the bend.

The cross-sectional profile of the groove and overhanging lips of the female strip is such that, when the bent over stud is snapped inside the groove, there is a three-point tangency to the stud—i.e., at the bottom of the groove and at one location on each lip. Tolerances in the dimensions of stud and groove are difficult to maintain in large scale production. The three-point tangency accommodates variations in the dimensions and still permits retention of the stud in the groove. Nevertheless, whenever it is necessary to debind, the stud may be removed from the groove.

In one modification of the invention the bottom of the groove is roughened in transverse teeth to grip the stud to restrain it if the pulling stress on the book might otherwise cause the stud to slip longitudinally of the groove. The length of the groove is longer than the bent-over portion of the stud, leaving room to engage the end of the stud to pull it out of the groove if it is necessary to debind the book.

Other objects of the present invention will become apparent upon reading the following specification and referring to the accompanying drawings in which similar characters of reference represent corresponding parts in each of the several views.

DESCRIPTION OF PREFERRED EMBODIMENTS

In the form of the invention shown in FIGS. 1–7, there is provided a male strip 21, preferably of a thin narrow plastic material. Integral therewith at spaced intervals along the strip 21 are flexible plastic studs 22 having pointed ends 23. The material of the studs 22 may be of polypropylene, K-resin and any group of thermoplastic elastomers. The stud length 24 which is in excess of the length necessary to accommodate the pages being bound is bent over. The flexible nature of the plastic material of which the studs 22 are formed makes it possible to bend the studs at a relatively abrupt angle.

Figure 1:
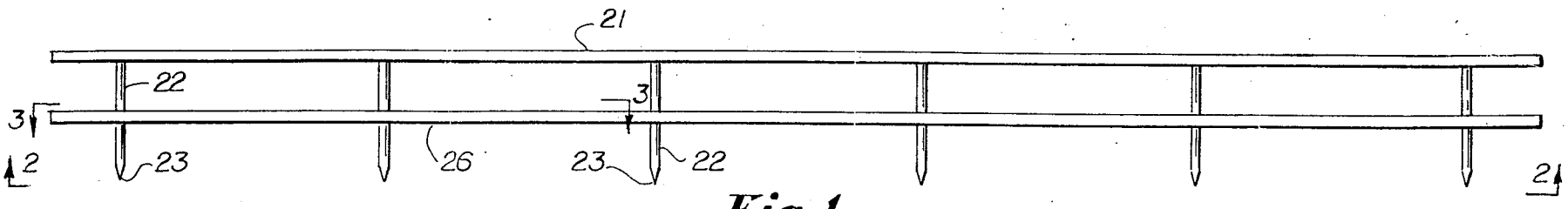
FIG. 1 is a side elevational view of strips in accordance with the invention.
Figure 2:
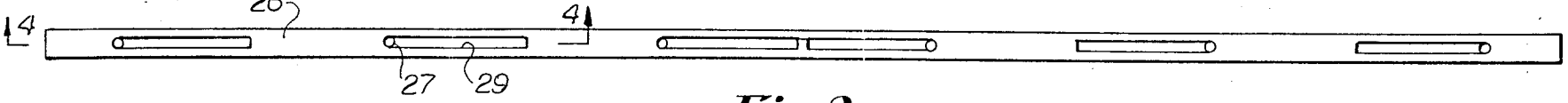
FIG. 2 is a bottom plan of the female strip as viewed along line 2—2 of FIG. 1.
Figure 3:
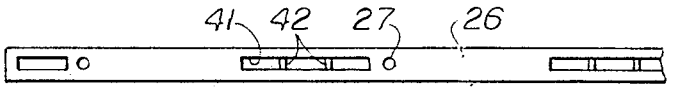
FIG. 3 is a fragmentary plan of the female strip as viewed along line 3—3 of FIG. 1.
Figure 5:
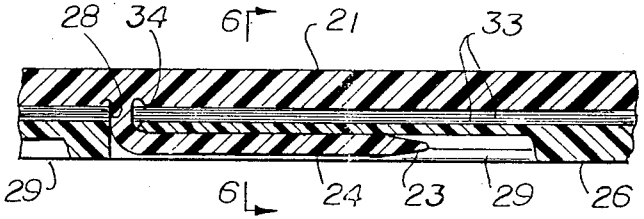
FIG. 5 is a fragmentary view of a portion of a bound book formed in accordance with the invention.
Figure 6:
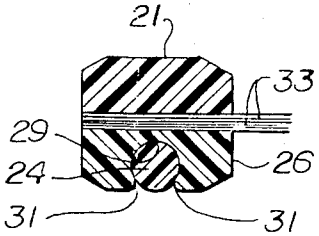
FIG. 6 is a sectional view taken substantially along line 6—6 of FIG. 5.
Figure 4:
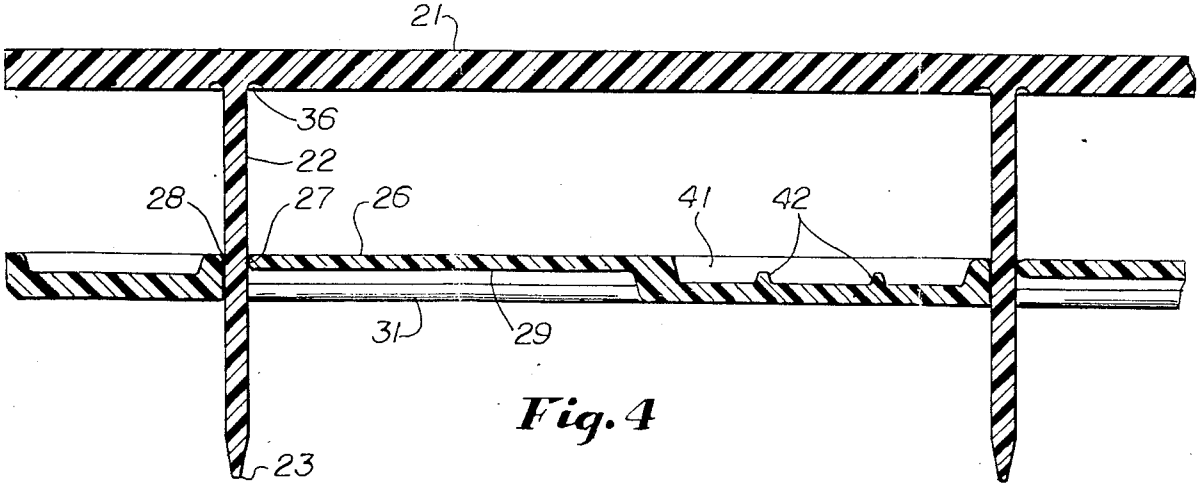
FIG. 4 is an enlarged, fragmentary sectional view taken substantially along the line 4—4 of FIG. 2.

The female strip 26 is likewise preferably of plastic and is formed with spaced holes 27 complementary to the spacing of the studs 22. To facilitate the tips 23 being inserted in holes 27, the bottom surface of strip 26 is preferably formed with a counterbore 28 around each hole 27, or countersink. The top surface of strip 26 is formed with longitudinally extending grooves 29 extending away from holes 27 to receive the bent portions 24. FIGS. 1–3 show six studs 22, the three on the left extending toward the right an the three on the right extending toward the left. Grooves 29 are formed with overhangs 31 along each upper edge. Thus, the bent over portion 24 snaps between the overhangs 31 and is retained in place thereby. The length of each groove is preferably slightly longer than stud 22 to permit a debinding tool to enter groove 29 and engage end 23 to pull the stud end away from the groove 29.

Strips 21 and 26 are preferably manufactured in large quantities by injection molding. Inherent in such molding are problems of shrinkage and variations in dimensions attributable even to such matters as the colorant used in the plastic formula. Accordingly, the shape of the groove 29 is formed to hold the stud end 24 therein despite variations in dimension of the stud 22 and groove 29.

Figure 8:
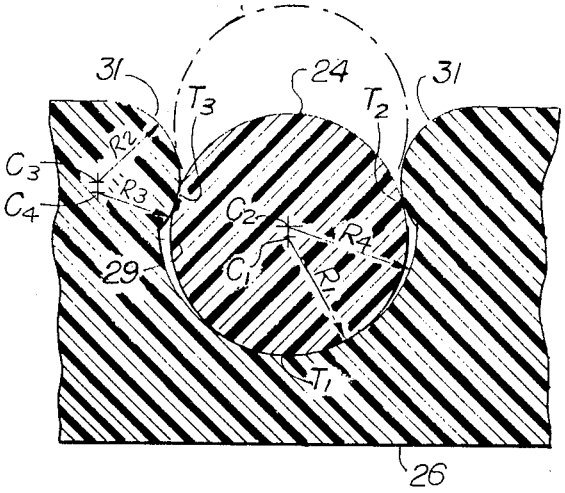
FIG. 8 is a greatly enlarged cross-section through a groove and stud of the present invention.

Directing attention to FIG. 8, the stud bent end 24 is circular in cross-section, the radius R-1 of the circle and its center C-1 being shown. The end 24 prior to insertion in the groove 29 is shown in dot-and-dash lines. The bottom of groove 29 is an arc having a radius R-4 slightly greater than R-1 and having its center C-2 correspondingly higher than C-1 so that the exterior of stud end 24 is tangent to the bottom of groove 29 at point T-1.

The overhangs 31 are preferably mirror images. The upper portion of the overhang 31 has a radius R-2 having a center C-3 and the lower portion of the overhang 31 is an arc having a radius R-3 substantially equal to R-2 with a center C-4 below C-3 approximately the same distance as the distance between C-1 and C-2. Thus, the lower portion of each lip 31 is tangent to the exterior of stud end 24 at points T-2 and T-3. It will be seen, therefore, that there is contact between the stud end 24 and the groove 29 at only three points—T-1, T-2 and T-3 and this holds the stud end 24 securely within the groove 29, despite variations in size within tolerances.

When the stud end 24 is depressed, it moves from the dot-and-dash position of FIG. 8 to the solid line position by contacting the surfaces bound by radii R-2 and forcing the lips 31 apart sufficiently so that the end 24 can pass the lips 31 and enter the bottom of the groove 29. Although it has been stated that the lips 31 are forced apart, there is also some deformation of the stud 24 to accommodate this movement.

When it is necessary to debind the book, a tool or other implement engages the pointed end 23 and pulls the same upwardly away from the bottom of the groove 29. The female strip 26 may be removed and pages 33 changed or pages may be added or subtracted. Thereupon, the same strips may be used to rebind the book.

The book of the present invention is used to bind a plurality of sheets 33 formed with holes 34 complementary to the spacing of the studs 22. The strip 21 is placed with studs 22, projecting upright. Sheets 33 are then assembled on the studs 22. Thereupon, the second strip 26 is installed over the studs 22, the counterbores 27 facilitating entry of the pointed ends 23. Thereupon the studs 23 are bent over at a right angle into the grooves 29.

Figure 7:
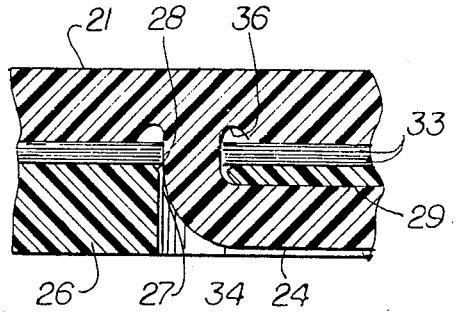
FIG. 7 is a further enlarged view of a portion of FIG. 5.
Figure 7A:
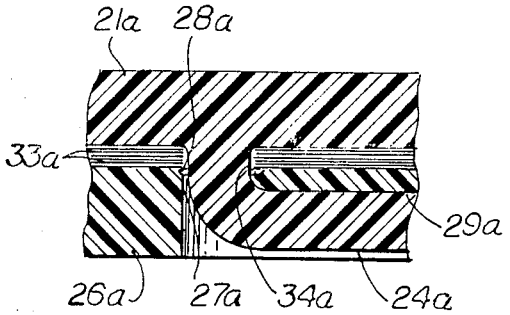
FIG. 7A is a view similar to FIG. 7 of a modification.

As best shown in FIG. 7, the depression 36 enables the stud to bend at a less abrupt angle and avoids breaking the stud. The angle may be contrasted with FIG. 7A where the depression 36 is not used and the bend of the stud more closely approaches a right angle. Depressions 36 are not essential. However, the thinner the number of sheets 33, the more desirable it is that the depressions be formed because of the abruptness of the bend of the stud is avoided.

Figure 9:
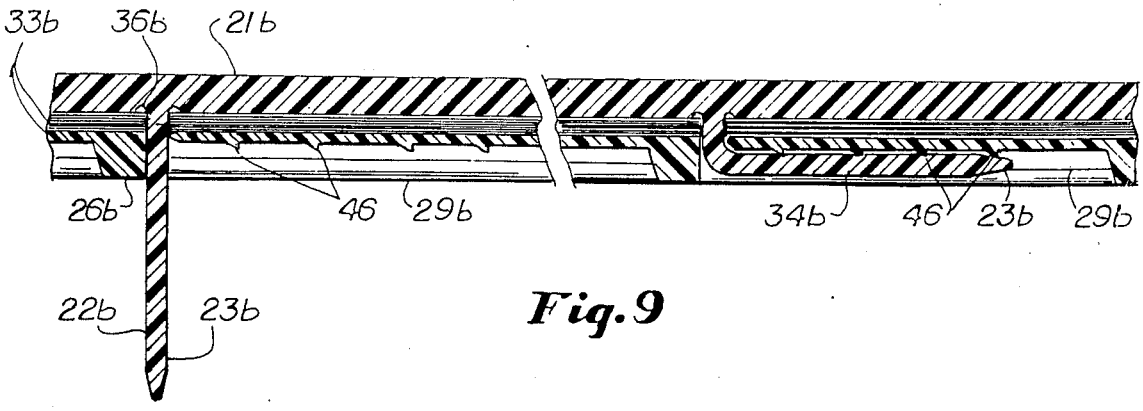
FIG. 9 is a view similar to FIG. 5 of another modification.

The excess stud lengths 24 snap between thedhangs 31 and a three point contact holds the bent portion 24 of the stud in place, despite variations in size.

Where pulling stresses on the assembled book are likely to be extreme, the structure of FIG. 9 may be used. Directing attention to the right-hand half of FIG. 9, it will be seen that the bottom of the groove **29*b* is formed with a plurality of tooth-like protrusions 46. When the stud 22*b* is bent to the position shown on the left side of FIG. 9, the protrusions 46 engage the stud end 24*b*. This engagement restrains the tendency of the stud end 24*b* to slide to the left and loosen or release the bind. In other respects, the structure of FIG. 9** resembles that of the preceding modifications and the same reference numeral followed by the subscript b is used to designate corresponding parts.

What is claimed is:

1. Strips for binding apertured sheets comprising a first strip, a second strip formed with a plurality of holes spaced longitudinally of said second strip and a groove in the outer surface of said second strip for each said hole communicating with one of said holes, and a plurality of smooth, round plastic studs with a first radius integral with said first strip, each said stud extending outward from said first strip, said studs being flexible and bendable at approximately a 90° angle, the lengths of each groove being slightly longer than the lengths of said studs and smooth surfaced overhangs along the longitudindal edges of each said groove adjacent only the outside of said grooves, said grooves having smooth walls, whereby the ends of said studs beyond said holes may be bent at approximately right angles and snapped under said overhangs, the lengths of said overhangs being substantially co-extensive with the lengths of said grooves, the bottoms of said grooves being curved in an arc of a second radius larger than said first radius, the outer edge of each said overhang being curved and the underside of each said overhang being also curved.

2. Strips according to claim 1 in which the combined lengths of all said overhangs on either side of said second strip is approximately equal to the combined lengths of said grooves.

3. Strips according to claim 1 wherein all said grooves extend from said holes inward toward the middle of said second strip.

4. A book comprising a plurality of sheets each formed with first holes spaced longitudinally of the spine edge of said sheet, a first strip, a second strip formed with a plurality of second holes at the same intervals as said first holes and a groove in the outer surface of said second strip for each said second hole communicating with one of said second holes, and a plurality of smooth, round plastic studs integral with said first strip, each said stud extending outward from said first strip through a first said hole and a second said hole and being flexible and bendable at approximately a 90° angle, the ends of said studs beyond said second holes being bent at approximately right angles and received in said grooves, the lengths of said grooves being slightly longer than said studs, and smooth surfaced overhangs along the longitudinal edges of each said groove adjacent only the outside of said groove, said studs being snapped under said overhangs, the lengths of said overhangs being substantially co-extensive with the lengths of said grooves, the bottoms of said grooves being curved in an arc of a radius larger than the radius of said studs, the outer edge of each said overhang being curved and the underside of each said overhang being also curved so that the said underside is tangent to said stud substantially only at one point.

5. A book according to claim 4 in which the combined lengths of all said overhangs on either side of said second strip is approximately equal to the combined lengths of said grooves.

6. A book comprising a plurality of sheets each formed with first holes spaced longitudinally of the spine edge of said sheet, a first strip, a second strip formed with a plurality of second holes at the same intervals as said first holes and a groove in the outer surface of said second strip for each said second hole communicating with one of said second holes, and a plurality of smooth, round plastic studs integral with said first strip, each said stud extending outward from said first strip through a first said hole and a second said hole and being flexible and bendable at approximately a 90° angle, the ends of said studs beyond said second holes being bent at approximately right angles and received in said grooves, said first strip being formed with an annular depression around the base where each said stud extends from said first strip so that said stud curves as it bends at said 90° angle.

7. Strips for binding apertured sheets comprising a first strip, a second strip formed with a plurality of holes spaced longitudinally of said second strip, and a groove in the outer surface of said second strip for each said hole and communicating with said hole, and a plurality of smooth, round plastic studs integral with said first strip, each said stud extending outward from said first strip and being flexible and bendable at approximately a 90° angle, whereby the ends of said studs beyond said holes may be bent at approximately right angles and received in said grooves, the length of each said groove being slightly longer than the length of said studs, and smooth surfaced overhangs along the longitudinal edges of said grooves adjacent only the outside of said grooves, said studs being flexible to snap under said overhangs, the lengths of said overhangs being at least substantially co-extensive with the lengths of said studs, said first strip being formed with an annular depression around the base where each said stud extends from said first strip so that said stud curves as it bends at said 90° angle.

8. A book comprising a pluralitY of sheets each formed with first holes spaced longitudinally of the spine edge of said sheet, a first strip, a second strip formed with a plurality of second holes at the same intervals as said first holes and a groove in the outer surface of said second strip for each said second hole communicating with one of said second holes, and a plurality of smooth, round plastic studs integral with said first strip, each said stud extending outward from said first strip through a first said hole and a second said hole and being flexible and bendable at approximately a 90° angle, the ends of said studs beyond said second holes being bent at approximately right angles and received in said grooves, the lengths of said grooves being slightly longer than said studs, and smooth surfaced overhangs along the longitudinal edges of each said groove adjacent only the outside of said groove, said studs being snapped under said overhangs, the lengths of said overhangs being substantially co-extensive with the lengths of said grooves, the bottoms of said grooves being curved in an arc of a radius larger than the radius of said studs, all of said studs on the first side of the middle of said first strip being bent inwardly toward the middle of said second strip and all of said studs on the second side of the middle of said first strip being bent inwardly toward the middle of said second strip.

* * * * *